United States Patent [19]

Adolph

[11] 4,157,002

[45] Jun. 5, 1979

[54] CROSS BRACING FOR WOOD TRUSS BUILDING WALL CONSTRUCTION AND THE LIKE

[76] Inventor: Floyd L. Adolph, 3315 Harris, Ferndale, Mich. 48220

[21] Appl. No.: 864,197

[22] Filed: Dec. 27, 1977

[51] Int. Cl.[2] ..... E04H 2/38

[52] U.S. Cl. ..... 52/657; 52/668; 52/693

[58] Field of Search ..... 52/693, 317, 657, 695, 52/668, 669, 732, 496, 779

[56] References Cited

U.S. PATENT DOCUMENTS

| | | | |
|---|---|---|---|
| 2,066,205 | 12/1936 | Keating | 52/732 X |
| 2,389,573 | 11/1945 | Balduf | 52/657 X |
| 3,138,229 | 6/1964 | Hubbard | 52/496 X |
| 3,591,997 | 7/1971 | Tennison, Jr. | 52/657 |
| 3,875,719 | 4/1975 | Menge | 52/657 X |

*Primary Examiner*—Price C. Faw, Jr.
*Assistant Examiner*—Carl D. Friedman
*Attorney, Agent, or Firm*—Dale Austin Winnie

[57] ABSTRACT

Wind and rack resistant cross bracing for wood truss building wall construction and which includes a metal strip or strap formed to include a pair of oppositely disposed lateral flanges having a depending reversely bent or U-shaped leg therebetween with a rolled bead formed in one or both opposite side walls; to extend the full length thereof and provide spring resistant spacing of the side walls of the leg portion for tight fitted engagement in a receptive channel groove or slot in the wall studs with which it is used and added rigidity against compressive loads in use and service.

6 Claims, 5 Drawing Figures

CROSS BRACING FOR WOOD TRUSS BUILDING WALL CONSTRUCTION AND THE LIKE

BACKGROUND OF THE INVENTION

In wood frame building construction using two-by-four studs on sixteen inch centers, as is conventionally done, cross bracing at corner posts for added structural strength and resistance to racking is of considerable importance.

Normally, under BOCA basic building code requirements, in buildings that are more than one story in height, and where necessary or desired for added strength in one story buildings, corner posts are made the equivalent of three (3) two-by-four studs with at least a one-by-four continuous brace extending diagonally across the next adjacent studs in each direction from the corner post and which is, preferably, in-set within the studs that it crosses. Or, alternatively, the diagonal bracing may be omitted if wood sheathing in the form of four-by-eight foot panels is applied with approved nailing at the corner sections.

Quite obviously, both the approved form of diagonal bracing and the alternate sheathing or panel method are more expensive and time consumming to accomplish than most builders are willing to put up with. And, moreover, once the skeleton walls are covered, in and out, no one really knows which, if either, method was used and consequently builders can and have been known to ignore these recommended proceedures.

In an effort to simplify corner bracing proceedures, and make it less expensive, attention has been given to providing a metal strip, or "strap", which extends diagonally across the two-by-four studs, out from each corner post, and which is formed to include a flange or leg section received in grooves provided in and aligned across each of the two-by-fours across which the cross bracing member extends.

Such members may be in any of the forms shown and suggested by U.S. Pat. No. 3,875,719 and they may be used for cross bracing, as between floor and roof joists, or wall bracing, as disclosed in the patent.

Of particular concern however, with this type of wind and rack bracing, is its rigidity in compression which depends in large part upon its close fitted or locked engagement in the grooves and to each two-by-four that it extends across. If the fit in the groove is loose then the compressive span is greater and although the channel groove flange may be U-shaped for added structural strength, it can still be buckled under a compressive load in such instances.

To avoid this problem, it is suggested that where the groove fit is loose a nail should be driven down through the U-shaped leg in the receptive groove to spread the side walls for a tighter fit and to hold the leg down in the groove. And, in doing so, about a 16 d nail is required for the cross-sectional breadth and relative length needed. This, in turn, is a sizable nail to be driven into a slot in a two-by-four in a manner that will create side wall pressure and could extend any fault line in the stud.

Also, the lateral flanges in this type of bracing, which offer the best method of tie-down, are not used for tie-down purposes as it is believed they should be.

Accordingly, improvements in this type of wind and rack bracing are considered necessary and are offered herewith.

SUMMARY OF THE INVENTION

This invention relates to cross bracing for wind and rack resistance in wood frame truss supports used in building wall construction.

In particular, this invention relates to an improvement in the form and use of metal strip or strap cross bracing for such purposes and which makes use of a metal member formed to include a pair of oppositely disposed lateral flanges with a depending reversely bent, or U-shaped, intermediate flange or leg that is formed and shaped to be received and retained within a groove or saw kerf that is provided in adjacently disposed parallel spaced wall forming studs and to extend diagonally there across.

The improvement is in having a rolled bead formed and provided in at least one side wall of the depending flange, and preferably in both, and which extends the full length thereof, to both relatively space and hold in yieldable spaced relation the side walls of the depending flange for better and closer fitted and tight engagement in the receptive slot or groove formed in and across the various wall forming studs with which it is used.

Such a preformed rolled bead in the side wall of the depending flange serves to add structural rigidity and provide added resistance under compressive loading. And, it also has the advantage of providing a groove or recess for the fibrous expansion of the side walls of the slot, that is cut into the two-by-four studs, into such space for retension of the flange in the saw cut or groove.

Of further significants, over the prior art uses, is having the lateral flanges, rather than the depending flange, nailed to the studs across which the bracing member extends. In this manner, a wider spacing of the nails is possible, tacking nails rather than driving nails can be used, and there is less chance or danger of splitting a stud on a fault line, in those instances where lower grade building materials may be used.

These and other objects and advantages in the practice of this invention will be more obvious in the detailed description of the preferred embodiment of the invention which is shown in the drawing figures and is described hereinafter.

IN THE DRAWING

THE ILLUSTRATED EMBODIMENT

Figure 1:
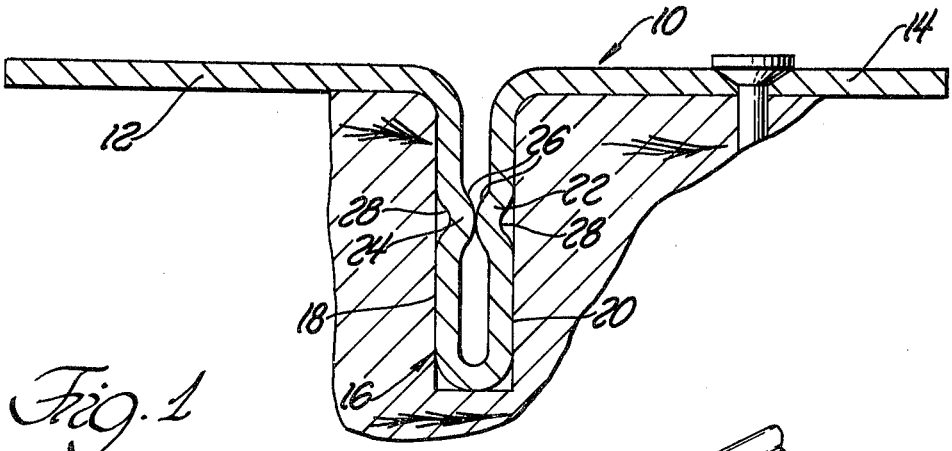
FIG. 1 is a greatly enlarged cross-sectional view of the proposed cross bracing member shown as disposed in a receptive slot in a fragmentary piece of a two-by-four stud, for discussion purposes.
Figure 2:
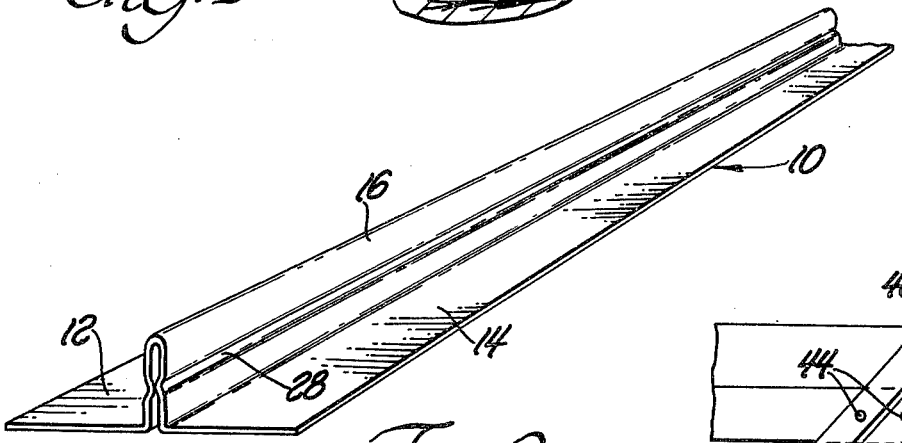
FIG. 2 is a perspective view of a length of the proposed bracing with its so-called depending leg, between oppositely disposed lateral flanges, turned upwardly.

The cross-sectional shape and general form of the cross bracing strip or strap member 10 of the present invention is as shown in the first drawing figure.

It is made from 0.038 H.D. minimum spangle galvanized steel sheet material, or the like, and is formed from flat strip stock about 2.75 inches in width, and in selected lengths, to provide a pair of oppositely disposed relatively parallel and laterally extended flanges 12 and 14 with a depending U-shaped section flange or leg 16 therebetween.

The overall width from the end of one lateral flange to the end of the other is just under two inches and the depending leg or flange is a little less than a half an inch in depth. The outer wall width of the depending leg or flange 16 is about ⅛ inch or just enough for a tight fit in a saw kerf slot made in and across the edge of a piece of two-by-four lumber, as has been mentioned and will be further described hereinafter.

Within the opposite side walls 18 and 20 of the depending flange or leg 16 are provided the rolled beads 22 and 24, which extend the full length thereof, and which are formed to provide the convex side or ridge 26 within the space between the side walls and with the concave or groove portion 28 on the outside walls.

The two ridges 26 on the opposite side walls 18 and 20 of the depending flange or leg 16 are disposed right across from each other and for relative interference and engagement sufficient to maintain a given spacing and provide a known and relatively constant width for the depending flange or leg 16 throughout its full length. At the same time, the rolled form and convex bead shape allows for yielding resistance sufficient to assure a tight fit and spring bias in the forced fit of the depending flange or leg 16 in a receptive saw cut or kerf.

It can also be appreciated that the full length rolled beads in the side walls of the depending U-shaped flange or leg adds further rigidity and structural resistance to deformation under compressive loading and that the outer disposed grooves provide access spaces for fibrous expansion of the side walls of the receptive slot within which the bracing member is fitted.

Figure 3:
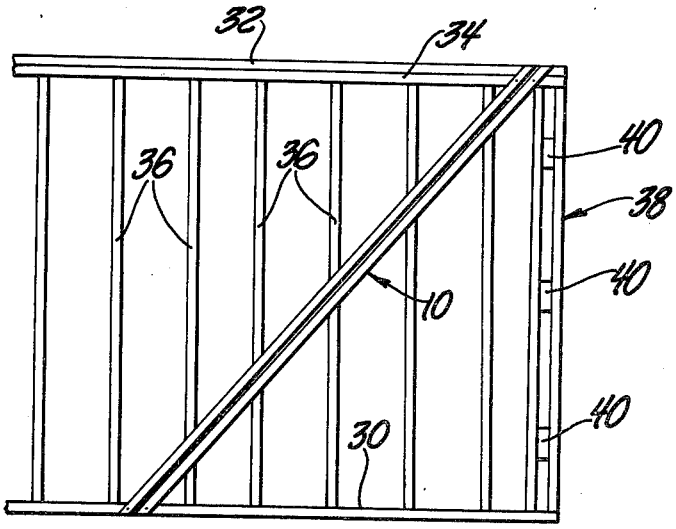
FIG. 3 is a side plan view of a wood truss building wall construction with the proposed bracing used for its intended purpose therewith.
Figure 5:
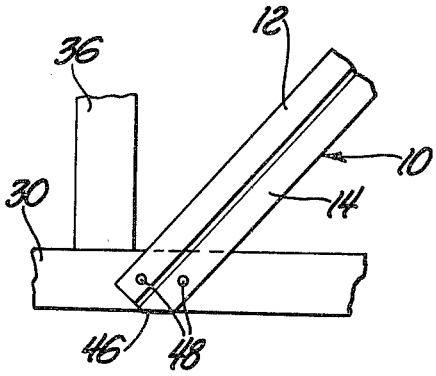
FIG. 5 is similar to the last mentioned drawing figure, showing the lower end attachment of the proposed cross bracing member.

Referring now to FIG. 3, a wood frame stud wall construction is shown which includes a base or floor plate member 30 with a pair of headers 32, 34 and a series of relatively spaced and vertically disposed two-by-four studs 36 therebetween. The corner post 38 is shown to include a pair of two-by-fours with spacers 40 therebetween which, as will be appreciated, gives sufficient width for an end wall stud on a wall section at right angles, to be joined thereto and still have a panel edge nailing surface in the corner.

Disposed diagonally across the wall studs 36, from the top corner to the floor plate, and at about a 45 degree angle, is the cross bracing member 10 which has been previously described.

Before the wall section is erected, the bracing member is laid across it, over where it will go, and each stud is marked, using the metal bracing member as a straight edge. Then an accurate kerf is sawed into each two-by-four to provide the channel groove within which the depending flange or leg 16 of the bracing member is to be received.

Using a hammer, the bracing member 10 has its flange or leg 16 driven into the kerf and so that its lateral flanges 12 and 14 lay flat against the stud and can be nailed thereto if and as desired. Normally there will be a very snug fit of the center flange part in the saw cut or kerf and only a few nails in alternate studs are necessary.

Figure 4:
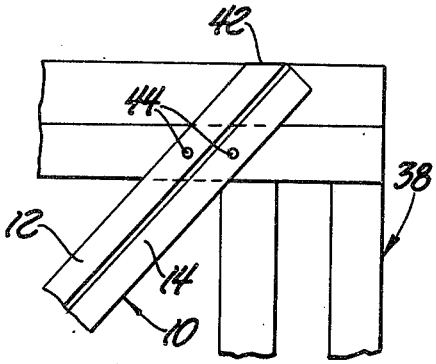
FIG. 4 is an enlarged view, with respect to the previous drawing figure, of the upper corner attachment of the proposed cross bracing member.

At the upper corner of the wall, as shown in FIG. 4. The corner 42 of the bracing member 10 is hammered over and is caused to grip the header. And, a couple of nails 44 are driven through the lateral flanges of the cross bracing member 10 on each side of the depending flange in the kerf.

At the lower end of the bracing member 10, where it is fastened to the stud wall, it again has its corner hammered over, as at 46, and a couple of nails 48 driven into the floor plate member through the lateral flanges 12 and 14 on each side of the depending flange in its kerf.

From the foregoing it will be seen that the cross bracing member 10 of the present invention is relatively simple in form and therefore reasonably inexpensive to manufacture. And that it can be made in given lengths or standard lengths that can be cut to selected lengths, as and when desired. Further, that it will have a greater structural rigidity throughout its length, with the rolled beads in opposite side walls of its depending flange, than it would if they were not present. And that this added rigidity will provide greated structural strength and resistance to compressive loads than otherwise.

In nailing the bracing member to the top and bottom framing members of a truss arrangement and to alternate intermediate truss members, as is done, the cross bracing member is fixed against relative movement. However, the close press fitted engagement of the inwardly beaded flange in the kerfs within each truss member that is crossed also serves a like purpose, in itself, in locking the cross bracing member in place.

I claim:

1. In a wood frame truss structure including a series of parallel spaced wooden truss members having relatively aligned grooves provided transversely thereacross and a metal cross bracing member received in part within said grooves and fastened to one or more of said truss members, the improvement comprising;

a metal cross bracing member formed to include a depending flange bent back on itself for added structural strength and to provide a width and depth for tight fitted engagement in the aligned grooves in said truss members, and said depending flange also including a rolled bead provided on at least one side thereof and extending the full length thereof for further enhancing the structural rigidity of said bracing member and the tight fitting self locking engagement thereof in said truss member grooves.

2. In the wood frame truss structure of claim 1, said metal cross bracing member having said bead rolled to provide means for fixing the spacing between the opposite side walls of said depending flange and to provide a groove externally thereof for wood fibrous expansion and interlocking engagement there within.

3. In the wood frame truss structure of claim 2, said metal cross bracing member having said bead provided in both side walls of said depending flange.

4. In the wood frame truss structure of claim 3, said beads, in each of said side walls, being relatively aligned and abuttingly engaged within said depending flange.

5. In the wood frame truss structure of claim 4, said cross bracing member being formed to include oppositely disposed lateral flanges of sufficient width for nailing to selected of said wooden truss members.

6. In the wood frome truss structure of claim 5, said lateral flanges at each selected truss member receiving a nail therethrough on each side of said depending flange.

* * * * *